United States Patent [19]

Kern et al.

[11] Patent Number: 4,679,156

[45] **Date of Patent: * Jul. 7, 1987**

[54] MICROPROCESSOR-CONTROLLED FIRE SENSOR

[75] Inventors: Mark T. Kern, Goleta; Robert J. Cinzori, Santa Barbara, both of Calif.

[73] Assignee: Santa Barbara Research Center, Goleta, Calif.

[ * ] Notice: The portion of the term of this patent subsequent to Sep. 18, 2001 has been disclaimed.

[21] Appl. No.: 641,816

[22] Filed: Aug. 16, 1984

Related U.S. Application Data

[63] Continuation-in-part of Ser. No. 265,764, May 21, 1981.

[51] Int. Cl.[4] ..... G08B 17/12; G08B 29/00

[52] U.S. Cl. ..... 364/551; 340/578; 340/587; 340/600

[58] Field of Search ..... 364/400, 550, 551; 340/577, 578, 587, 588, 589, 600; 371/16, 20; 116/5, 101

[56] References Cited

U.S. PATENT DOCUMENTS

| | | | |
|---|---|---|---|
| 3,967,255 | 6/1976 | Oliver et al. | 340/578 |
| 4,122,996 | 10/1978 | Wilczek | 371/20 |
| 4,200,224 | 4/1980 | Flint | 371/16 |
| 4,245,309 | 1/1981 | Kiefer | 37/20 |
| 4,280,184 | 7/1981 | Weiner et al. | 340/578 |
| 4,414,542 | 11/1983 | Farquhar et al. | 340/578 |
| 4,469,944 | 9/1984 | Kern et al. | 340/587 |
| 4,472,715 | 9/1984 | Kern et al. | 340/578 |
| 4,499,581 | 2/1985 | Miazga et al. | 371/20 |
| 4,533,834 | 8/1985 | McCormack | 340/578 |
| 4,553,031 | 11/1985 | Cholin et al. | 340/578 |

FOREIGN PATENT DOCUMENTS

| | | | |
|---|---|---|---|
| 0036276 | 9/1981 | European Pat. Off. | 340/577 |
| 2907546 | 11/1979 | Fed. Rep. of Germany | 340/578 |

*Primary Examiner*—Gary Chin

*Attorney, Agent, or Firm*—Ronald L. Taylor; A. W. Karambelas

[57] ABSTRACT

A fire sensor that can perform a sophisticated analysis of the outputs of radiant energy detectors, while minimizing size, weight, and cost, by employing a microprocessor to analyze the detector outputs. In one embodiment, an Intel 2920 Signal Processor is utilized as the microprocessor. An alternative embodiment incorporates an RCA 1802 microprocessor to achieve fire sensing while discriminating against false signal radiation.

20 Claims, 9 Drawing Figures

FROM FIG. 3B

IS P > T + 10mv
YES
SET A = 1
NO
IS A = 0
NO
SET A = 0
SET B = 100
YES
IS B < 0
NO
B = B-1
YES
K = 1
IS B < 0
NO
INHIBIT = 1
YES
IS T > THR
NO
INHIBIT = 1
YES
IS P > THR
NO
INHIBIT = 1
YES
TO FIG. 3D

FROM FIG. 3C

IS INHIBIT =0
YES
NO
IS K=1
NO
YES
SET BITE OUTPUT HIGH
IS K=1
YES
NO
SET FIRE PULSE OUTPUT LINE HIGH
SET INHIBIT =0
F = F - 1/8192
H = H - 1/2^24
F<0
NO
J=1
YES
H<0
NO
J=1
YES
J=0
YES
SET BITE DETECTOR DRIVE HIGH
K = 1
B = 100
NO
RETURN TO START
TO FIG. 3A.

MICROPROCESSOR-CONTROLLED FIRE SENSOR

RELATED APPLICATION

This application is a continuation-in-part of U.S. patent application Ser. No. 265,764 filed May 21, 1981, entitled "Microprocessor-Controlled Fire Sensor."

BACKGROUND OF THE INVENTION

1. Field of the Invention

This invention relates to the field of fire sensors generally, and in particular, to fire sensors using microprocessors instead of discrete analog circuits to determine whether a fire exists.

2. Background of the Invention

There presently exist many techniques for sensing the presence of fires or explosions within a protected area, and for discriminating against other phenomena that create false alarms. Some examples of phenomena which fire sensors discriminate against include sunlight, small fires, explosions which do not cause a fire, and the flash created by a projectile piercing a wall of the protected area. Previous discrimination techniques use various combinations of spectral selection and various comparisons between the sensed energy of the various spectral regions. Prior art discrimination techniques have employed discrete analog circuitry, such as op-amps and comparators, in conjunction with a few digital gates. Such discrimination circuits have been kept intentionally simple because the fire sensor packages must remain small and light to be useful. Complex circuitry also increases the selling price of the fire sensor. It would be advantageous to obtain a fire sensor that is light, small, and inexpensive while still being able to perform relatively complex analysis of the radiation sensed. It would also be desirable to realize the discrimination circuitry in a form wherein the discrimination techniques could be readily changed without discarding or changing the actual hardware. Such advantages have not been obtainable with prior art fire sensors.

SUMMARY OF THE INVENTION

It is a purpose of this invention to provide a new and improved fire sensor which overcomes the above-described disadvantages of the prior art fire sensors, and which is operable to detect the presence of a fire and cause the release of a fire suppressant.

It is also a purpose of this invention to provide a new and improved fire sensor that is relatively small, light, and inexpensive while still being able to perform relatively complex analysis of the radiation it senses.

It is further purpose of this invention to provide a new and improved fire sensor having discrimination circuitry that is programmable, so that analysis of the radition sensed can be changed without altering the discrimination hardware.

To accomplish these purposes while overcoming the disadvantages of the prior art described above, the present invention provides a fire sensor system having one or more detector means in combination with an integrated circuit microprocessor.

BRIEF DESCRIPTION OF THE DRAWINGS

A better understanding of the present invention may be had from a consideration of the following detailed description in which.

DETAILED DESCRIPTION OF THE INVENTION

Figure 1:
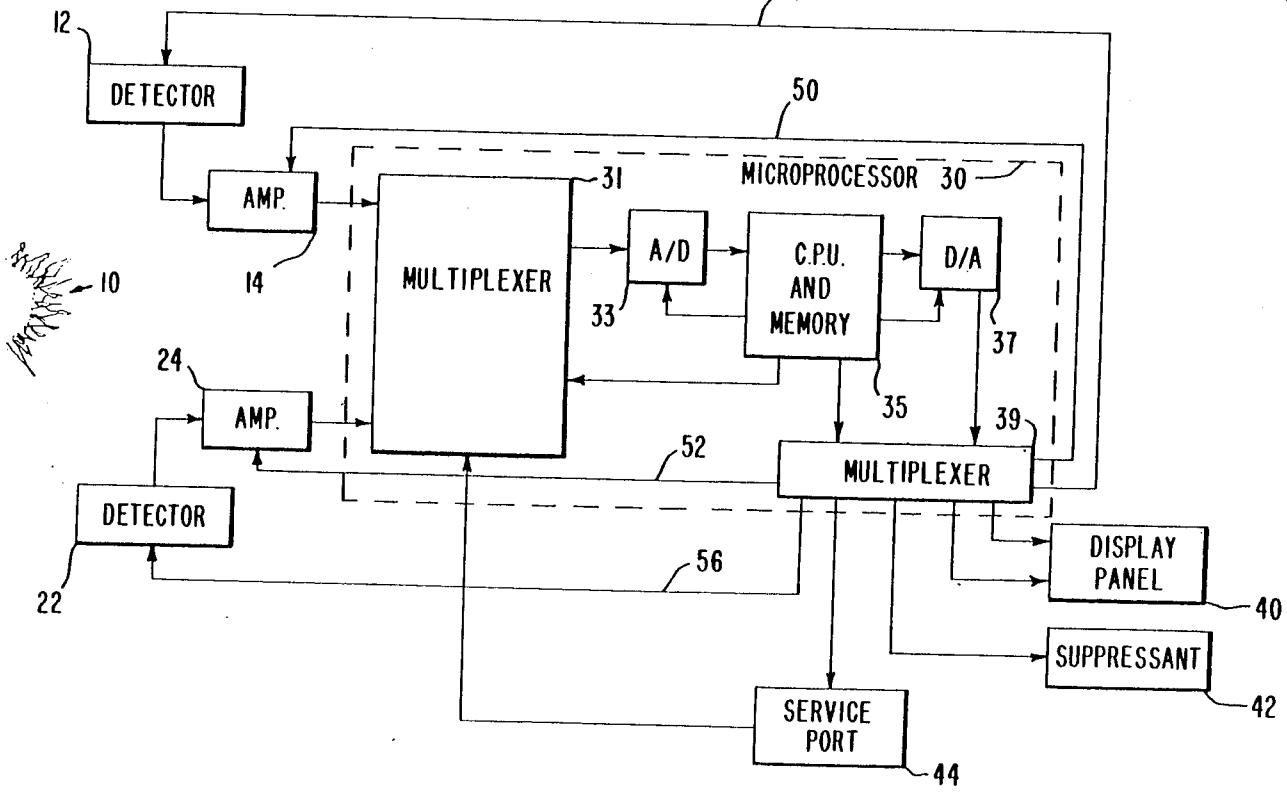
FIG. 1 is a block diagram of a fire sensor system according to a preferred embodiment of this invention.

A microprocessor-controlled fire sensor according to the present invention is shown in FIG. 1. The fire sensor has two detector channels each having one detector capable of sensing electromagnetic energy from a radiation source 10 having a wavelength within a certain spectral band. Typically, a first detector 12 is capable of sensing only radiation having a wavelength of from 0.7 microns to 2.0 microns, and a second detector 22 is capable of sensing radiation in the 5 to 30 micron spectral region. Since the output amplitudes of the optical detectors 12 and 22 are usually too small to be fed directly to a microprocessor, the detector outputs are amplified by analog amplifiers 14 and 24, respectively, and fed to a microprocessor 30. The detector 12 is a commercially available silicon photodiode, and the detector 22 is a radiation thermopile. The amplifiers 14 and 24 are commercially available operational amplifiers. The microprocessor 30 in the preferred embodiment is a Model 2920 Signal Processor, made by Intel, Inc. of Santa Clara, Calif. Of course, depending upon the particular application, other microprocessors may be substituted for the Intel 2920. The Intel 2920 Signal Processor is described in detail in the 1980 Intel Component Catalog, published by Intel, Inc., pages 4–43 to 4–50, which is incorporated herein in its entirety.

A simplified block diagram of the Intel 2920 is shown within the broken lines of FIG. 1. The amplified inputs from the detectors 12 and 22 are fed to an input multiplexer 31. The input multiplexer 31 chooses one of the input signals and transmits it to an analog-to-digital (A/D) converter 33, where the analog signal is converted to a digital signal. That digital signal is fed to a central processing unit (CPU) 35 while the input multiplexer 31 feeds the other input signal to the A/D converter 33. The other input signal is converted to digital form and fed to the CPU 35 in the same manner.

The input multiplexer 31 samples each of the amplified analog signals from the detectors 12 and 22, one at a time, feeding each sampled signal individually to the A/D converter 33 and thereby to the CPU 35. When each digitized sample of information reaches the CPU 35, it is operated on in the manner programmed into the microprocessor 30. The microprocessor 30 can be programmed and reprogrammed to perform various routines on the detected information without altering the hardware of the system.

When the CPU 35 reaches a decision based on the input information, digital commands are converted to analog signals via a digital-to-analog (D/A) converter 37. The command signal directs the output demultiplexer 39 to feed the analog command signal to the proper output circuit. For instance, if the CPU 35 determines that the detectors have sensed a small fire that does not require use of the suppressant, the analog command signal may be fed to a display panel 40 where it will activate a "small fire" indicator (not shown). If, however, the CPU 35 determines that there is a dangerous fire or explosion occurring, the output demultiplexer 39 will feed the command signal to suppressant circuit 42 that will release a fire suppressant.

The input and output multiplexers 31 and 39, the A/D converter 33, and the D/A converter 37 are all controlled by the CPU 35. Likewise, the detector amplifiers 14 and 24 are controlled by the CPU 35 through the output demultiplexer 39. If the amplified detector signals saturate, or exceed the microprocessor's input signal range, the CPU 35 will order the output demultiplexer 39 to reduce the gain of the amplifiers 14 and 24 via feedback lines 50 and 52. The CPU program will then compensate for the reduced analog gain by processing the resulting digital information with an appropriate scale factor.

The CPU 35 can also be programmed to check itself periodically. The CPU 35 will command the output demultiplexer 39 to stimulate the detectors 12 and 22 with various test conditions via feedback lines 54 and 56 in accordance with a BITE (Built In Test Equipment) routine described in detail below. If the signals coming back to the CPU 35 are of the proper amplitude and timing, and the self-check routine indicates that the CPU 35 has itself followed the appropriate steps processing the data, an output will be generated and sent to an indicator on the display panel 40 to indicate that all is well. If something is found to be wrong during the test routine, the CPU 35 can be commanded to perform a diagnostic test routine from a service port 44 to isolate the faulty component. The service port 44 can also be used to initiate the BITE routine upon the application of an INITIATE BITE signal by the technician. The self-check routine may be supplied automatically and periodically by the CPU 35 by an appropriate program of the CPU 35. The automatic check program should include a provision that the check routine not be initiated if the signal from either amplifier 14 or amplifier 24 is greater than a predetermined value, so that a check routine is not initiated just as a real fire is developing.

The result of the microprocessor sampling of each input and operating on successive samples according to the program software is a fairly sophisticated waveform analysis. The microprocessor 30 can, for example, be programmed to detect a small flickering fire and indicate that fact. If the fire becomes dangerous, the microprocessor 30 will automatically cause a suppressant to be released. The microprocessor 30 can also recognize the flash of a projectile striking within the field of view and "watch" it decay. If the projectile starts a fire, the microprocessor 30 will analyze the fact that the detector flash is not decaying as expected and cause suppressant to be released.

Figure 2:
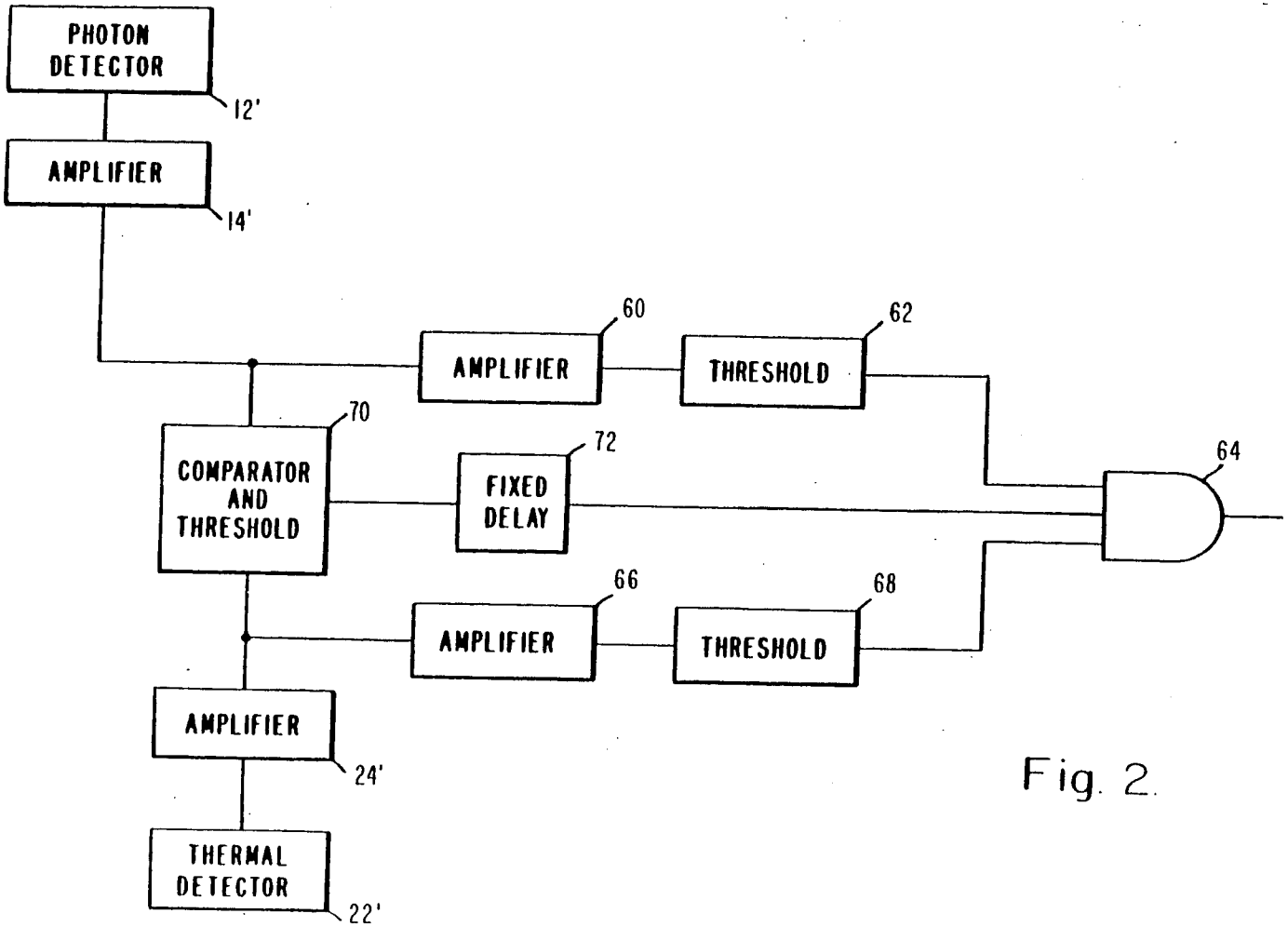
FIG. 2 is a block diagram of one particular fire sensor circuit which corresponds to the operation of the system of FIG. 1 in one particular mode.

The circuit of FIG. 2 is provided to illustrate particular circuit functions which may be performed by the microprocessor 30 in the system of FIG. 1 with appropriate programming to cause the microprocessor to operate pursuant to the flow diagram of FIGS. 3A–3D. The circuit of FIG. 2 is designed to discriminate between a sudden flash of radiant energy, such as may occur when a projectile penetrates an armored vehicle, and a fire that develops so soon after the flash that the fire's radiant energy might be interpreted by a detector system as a continuation of the flash. FIG. 2 shows a photon detector 12', a thermal detector 22' and associated amplifiers 14' and 24', corresponding to the detectors 12, 22 and amplifiers 14, 24 of FIG. 1. A first channel leading from the amplifier 14' incorporates another amplifier 60 and threshold stage 62 in series, leading to one input of an AND circuit 64. A second channel leading from the amplifier 24' incorporates an amplifier 66 and threshold stage 68 in series, leading to another input to the AND circuit 64. The output of the AND circuit, when active, causes the release of the fire suppressant to distinguish a fire which has been detected by the system and identified as a fire and not projectile penetration flash radiation.

The circuit of FIG. 2 includes a third channel comprising a comparator and threshold stage 70 connected between the inputs of the first and second channels and connected in series with a fixed delay stage 72 which provides a third input to the AND circuit 64. In the circuit of FIG. 2, the outputs of the amplifier 14', 24' are fed to the inputs of the comparator/threshold circuit 70. This circuit generates an output signal, applied to the fixed delay stage 72, whenever the difference between the amplitudes of its two input signals exceeds a predetermined threshold value. The signals from the amplifiers 14', 24' are also applied via the respective first and second channels and develop active inputs to the AND circuit 64 if their respective amplitudes exceed predetermined threshold values, as determined by the threshold stages 62, 68. The fixed delay stage 72 is of a type which generates a logical control signal at its output in the absence of an input signal from the comparator/-threshold circuit 70. Thus, an output fire suppressant control signal from the AND circuit 64 is activated upon coincidence of signals from the photon detector 12' and thermal detector 22' which exceed their respective thresholds. However, should there be a difference between the amplitudes of the respective detection signals in excess of the comparator threshold value, the comparator/threshold stage 70 generates an output signal which inhibits the control signal from the delay stage 72. This output signal is inhibited as soon as the comparator/threshold 70 generates an output, and for the duration of the predetermined time period of the delay stage 72. In this manner, the release of the fire suppressant is timed to occur at the particular point in time following radiation detection when it will be most effective, and discrimination is provided against release of the fire suppressant in response to only the flash of the projectile penetration.

Operation of the microprocessor 30 of FIG. 1 in accordance with programming to accomplish the function of the circuit of FIG. 2 is illustrated in the flow diagrams of FIGS. 3A–3D. For this operation, amplifiers 14 and 24 are configured with gains switchable by factors of 16 to 256 (4 bits/step). The microprocessor converts the analog signal to digital form to an accuracy of 8 bits plus a sign bit. When the analog signal (converted to digital form) exceeds the 8 bits, an overrange signal is generated and the gains of amplifiers 14 or 24 are reduced by a factor of 16. Since a resolution of at least 4 bits is desired over the full dynamic range, should either signal Pn or Tn have zeros for its four most significant bits (MSB's), an underrange signal will be generated and the gains of amplifiers 14 or 24 will be increased by a factor of 16.

Figure 3A:
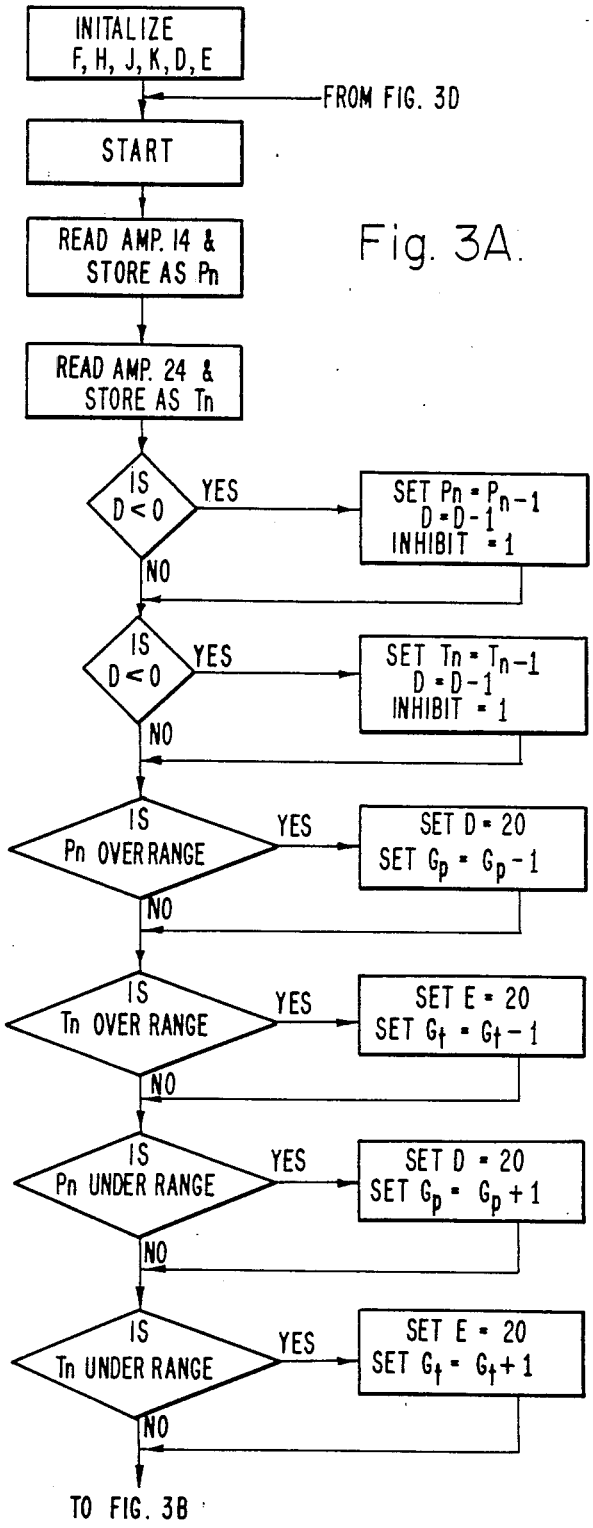
FIGS. 3A–3D depict a flow diagram for the microprocessor of the system of FIG. 1 to perform the functions indicated in the circuit diagram of FIG. 2.
Figure 3B:
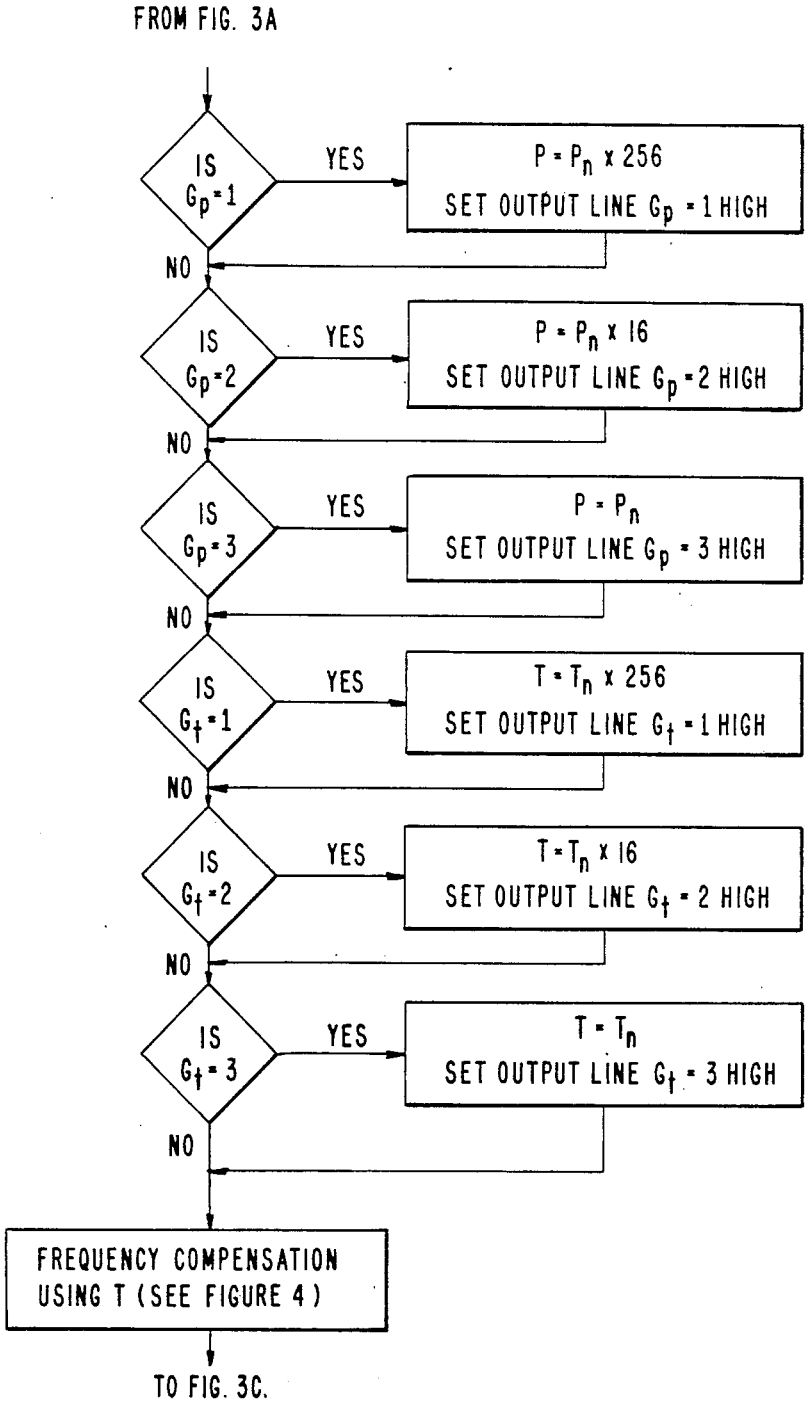
Figure 3C:
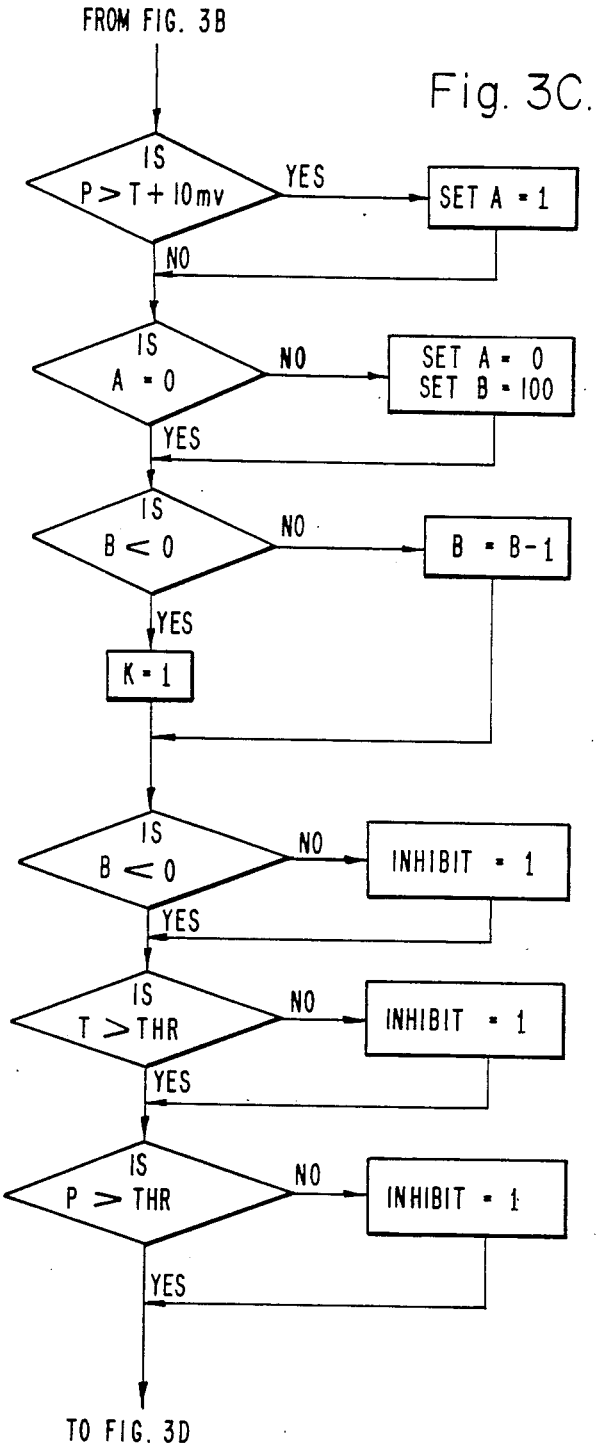

This is illustrated in the flow chart portion of FIGS. 3A-3B wherein the various parameters were defined as follows:

A has the value of either 0 or 1 and is used for providing a comparison following the P greater than T comparison (see FIG. 3C).

B has a value between 0 and 100 as determined by a B counter and provides a delay following the above comparisons.

D has a value from 0 to 20 as provided by a D register, and provides a delay following a change in the range of the P (photon) signal amplifier 14.

E has a value from 0 to 20 as provided by an E register, and provides a delay following a change in the range of the T (thermal) signal amplifier 24.

Gp represents the photon channel gain level and may assume the values of 1, 2 or 3.

Gt represents the thermal channel gain level and may assume the values of 1, 2 or 3.

Tn represents the nth reading of the thermal signals.

T(n−1) represents the (n−1)th reading of the thermal signal.

T represents the thermal signals as corrected for range switching.

Pn represents the nth reading of the photon signal.

P(n−1) represents the (n−1)th reading of the photon signal.

P represents the photon signal as corrected for range switching.

THR represents the particular normalized pan fire sensitivity level (threshold) which is desired and is preset into the program—e.g. a 14-inch diameter pan of No. 2 diesel fuel at a distance of five feet.

INHIBIT=1 indicates a signal which blocks the generation of a fire pulse output.

F represents the contents of an F register. F is greater than 0 when there has been no photon signal, T greater than THR, or P greater than (T+10 mv) for an interval of eight seconds.

H represents the contents of the H register and provides a 28 minute timing signal for the BITE test.

J represents a memory cell content with a value of 0 or 1. When J equal 1, the BITE test cannot be initiated.

K represents a memory cell content with a value of 0 or 1. When K equals 1, it indicates that the BITE test is in progress.

When operation of the microprocessor 30 is initiated, stages F, H, J, K, D and E are initialized. Thereafter, the CPU/memory 35 of the microprocessor 30 cycles in accordance with the flow chart of FIGS. 3A-3D. Signals from the amplifiers 14 and 24 are read and stored as Pn and Tn, respectively. Using the Intel 2920, delays are generated by counting passes through the program (since looping and branching are not mechanized). When a gain change is made, counters D and E thus count 20 passes through the program (at about 100 microseconds per pass), or about two milliseconds, to allow amplifiers 14 and 24 to settle. During the settling time, the values of Pn and Tn are held at the values existing prior to the gain change. As a result of three possible gain factors (i.e. 1, 16, and 256), a dynamic range of 16 bits (or 65, 536) is attained with a resolution of at least 1 bit. In order to make valid comparisons, however, at least a four-bit signal is required. If one thinks of the useful dynamic range as being that where every signal to be compared has at least four bits, then the dynamic range becomes 12 bits (or 4096). To obtain the final values of P and T, Pn and Tn are multiplied by the appropriate gain factor of 1, 16, or 256 (see FIG. 3B) in order to yield as close as possible to a non-discontinuous function in the memory.

While the A/D converter only converts 8 bits plus a sign bit, the digital processing utilizes 24 bits. Thus the 8 bit signal from the amplifiers is shifted appropriately such that multiplication by 256 does not cause saturation. This shifting is explained in the Intel 2920 operating manual.

Figure 4:
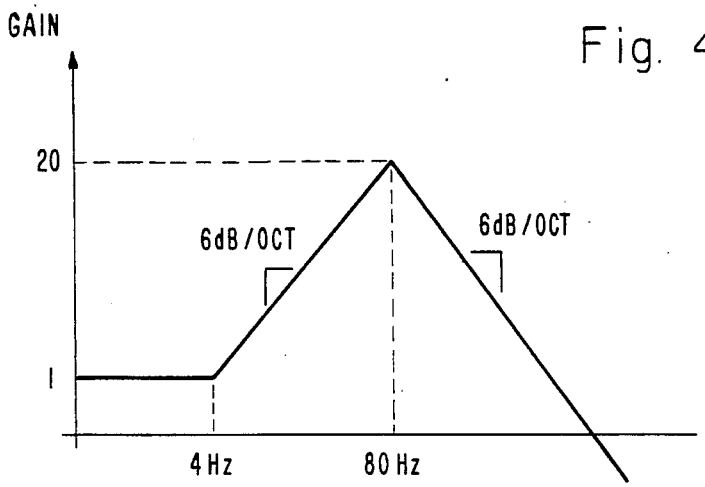
FIG. 4 is a graph of gain versus frequency to illustrate a particular frequency compensation for certain signals in the system of FIG. 1.

Once T and P are in memory, a frequency compensation is performed on T in accordance with the gain-vs.-frequency relationship shown in FIG. 4. This is to compensate for the frequency response of the thermal detector. This frequency compensation is mechanized by a digital filter (not shown) using Z Transforms to match the analog represenation of FIG. 4. In practice, this is relatively straightforward. The Intel Microprocessor Development System available as a tool to program the 2920 accepts LaPlace notation in poles and zeros and converts the LaPlace format into the necessary code to program the 2920. Thus FIG. 4 represents only a few program steps and takes only a few minutes to implement.

Once frequency compensation is complete, the flow chart outlines the signal analysis performed to achieve equivalent results to the circuit of FIG. 2. In this example, a comparison is made between P and T (see FIG. 3C). When P is greater than T+10 mV, an inhibit condition (A=1) is generated and maintained for 100 passes through the program after P is less than T+10 mV (or about 10 milliseconds).

Once this comparison and delay have terminated, T and P are queried as to whether they are above the established sensor threshold. If both are above this threshold, a fire pulse output is generated. Otherwise the inhibit signal is set to equal 1.

Figure 3D:
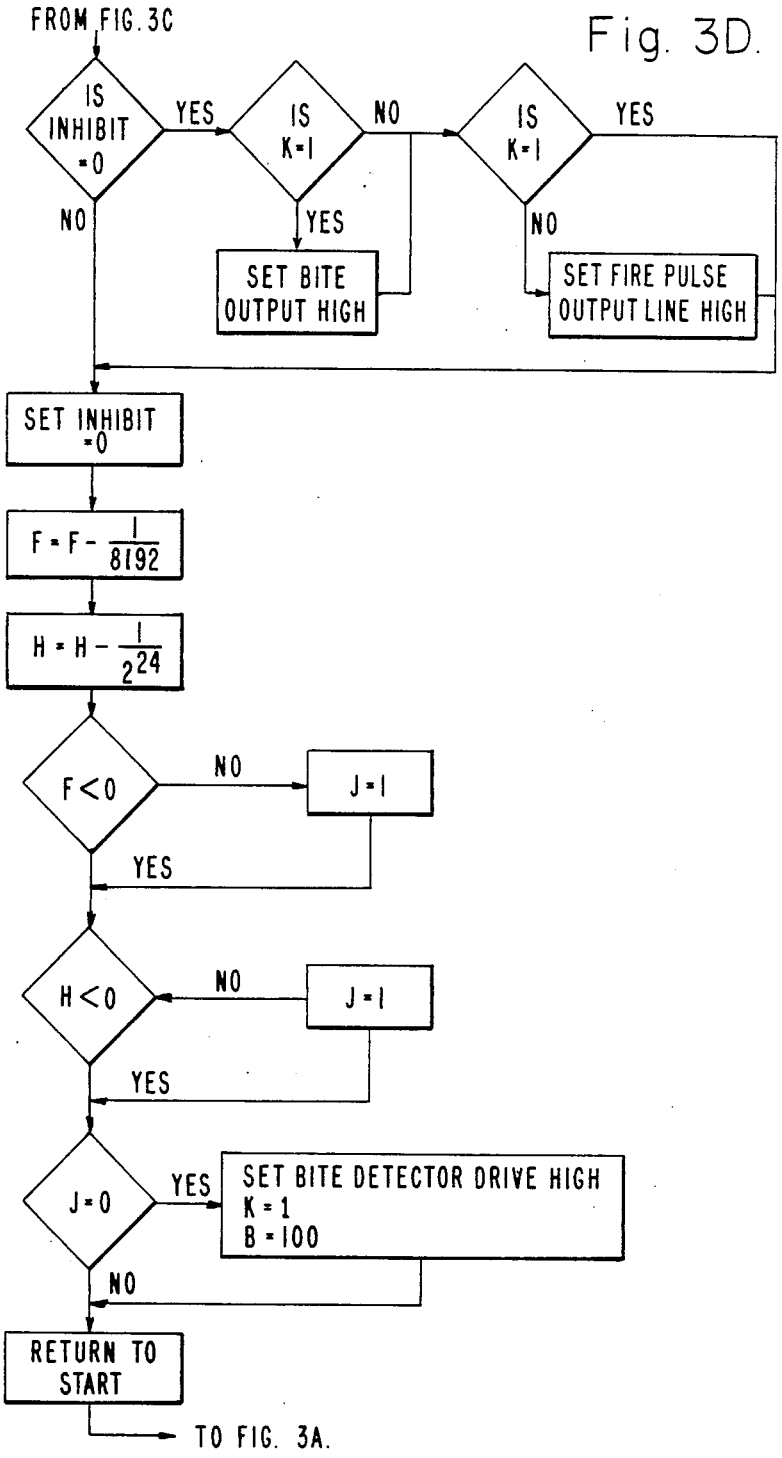

The flow chart shown includes a BITE sequence which generates a timer such that a BITE test is generated approximately every ½ hour. This is mechanized by stepping a memory location by 1 LSB (least significant bit) each pass through the program. Doing such generates a sawtooth signal in the memory location with a period of about 28 minutes. When a BITE test is being run, K=1 which as shown at the top of FIG. 3D prevents any Fire Pulse output.

The F register is used to count a shorter period—about eight seconds—during which period the sensor has had no activity. As shown in FIG. 3D, this second period corresponds to 8192 passes through the program and occurs only if neither P greater than T+10 mV, P greater than THR, nor T greater than THR has occurred. If any of these occur, the counter is reset to zero.

When the first timer (the H counter) makes the positive to negative transition of its sawtooth signal, logic is mechanized to wait for the next time that the second (F) counter counts up to 8192. At that point a BITE signal is sent to the detectors 12, 22 to drive the test stimulus for 100 passes through the program. During these 100 passes, the Fire Pulse output line is inhibited and P and T are queried to ascertain whether they attained the appropriate levels. Whether they did or did not, an output line is energized to report sensor status to a display panel. This display panel may be connected to the service port 44, if desired, such that an external input from the service port can be used to probe the sensor status by starting the BITE sequence, rather than waiting for up to ½ hour for the sensor to test itself.

Figure 5:
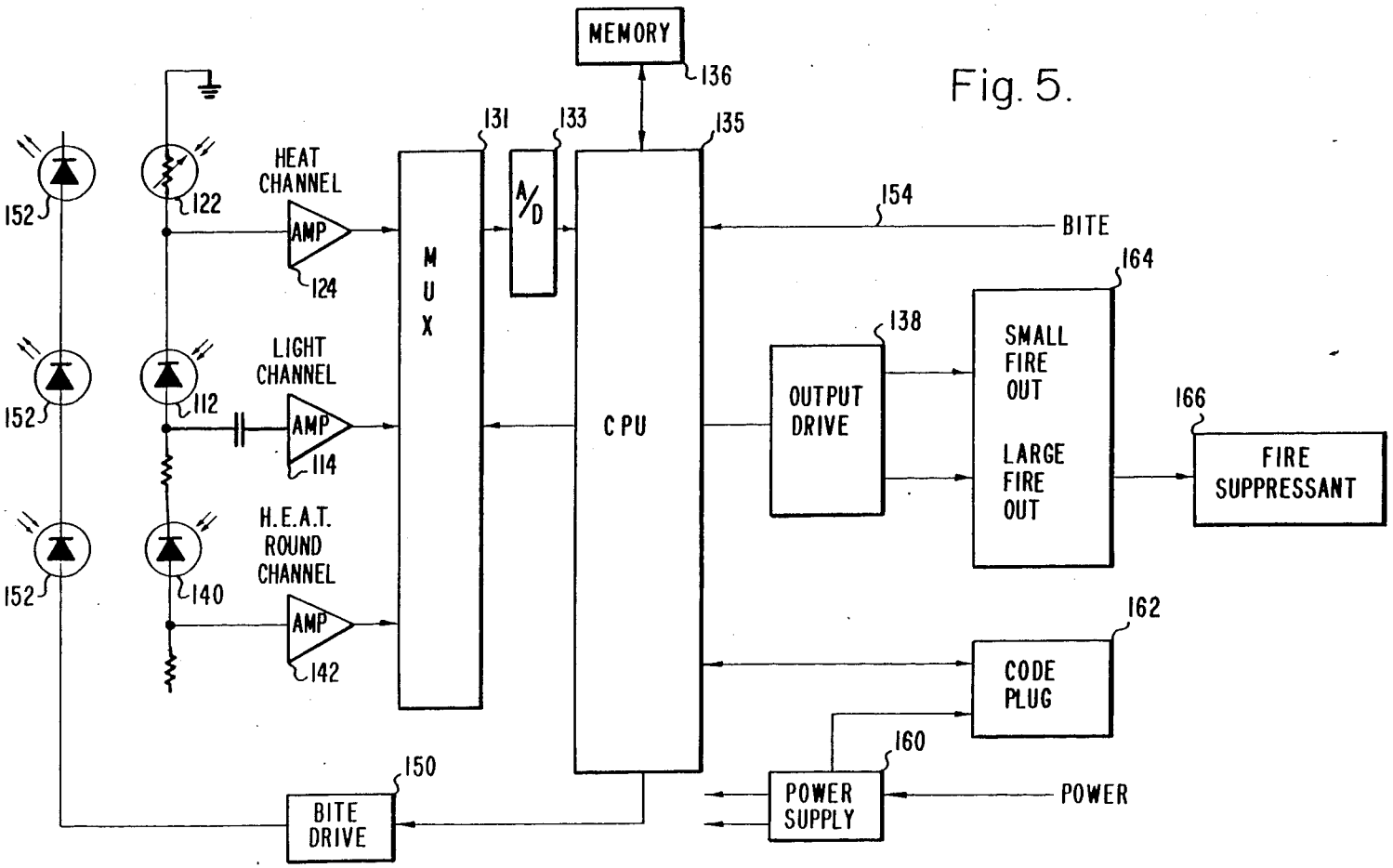
FIG. 5 is a block diagram illustrating an alternative implementation of the system of FIG. 1, as adapted to use a different microprocessor to provide other fire detection features.

FIG. 5 shows a block diagram of an alternative microprocessor control fire sensor system in which an RCA 1802 microprocessor is substituted for the Intel 2920. In the circuit of FIG. 5, a light channel comprising a photon detector 112 and amplifier 114, and a heat channel comprising a thermal detector 122 and amplifier 124 are shown coupled to provide two inputs to a multiplexer 131. The multiplexer 131 and an A/D converter 133 must be added separately in the circuit, since the CPU 135 of the RCA 1802 microprocessor does not include those modules.

The RCA 1802 also requires a level translator 138 for the output drive from the microprocessor for communication with a display panel 164 and other electronics for release of the suppressant from a fire suppressant stage 166.

The third channel comprising a silicon photodiode detector 140 and amplifier 142 are added to a third input to the multiplexer 131 to achieve HEAT round discrimination. A fire detection system providing for HEAT round discrimination is disclosed in U.S. Pat. No. 3,825,754. This discrimination feature derives its name ("HEAT") from "High Energy Anti-Tank round discrimination" and serves to discriminate against projectile penetration flash radiation—that is, armor penetration and/or round explosions per se which do not produce a full scale explosive fire.

With the use of a separate HEAT round channel, the need for the gain adjust feature (lines 50 and 52) to amplifiers 14 and 24, respectively, of FIG. 1 which is provided by the Intel 2920 is eliminated. In the embodiment of FIG. 5, signals from detectors 112, 122 are normally within the eight-bit dynamic range of the A/D converter 133. Should the dynamic range of the A/D converter 133 be exceeded, the circuit still registers a very large fire.

For extremely large light signals beyond the dynamic range of the detector 112 and A/D converter 133, the HEAT round detector channel is utilized. Small signals from the HEAT round detector 140 are present when corresponding signals from the photon detector 112 are in saturation (in the A/D converter 133). Thus the additional detector (HEAT round channel) provides the "over range" which is implemented by the feedback paths 50, 52 of the system of FIG. 1.

Figure 6:
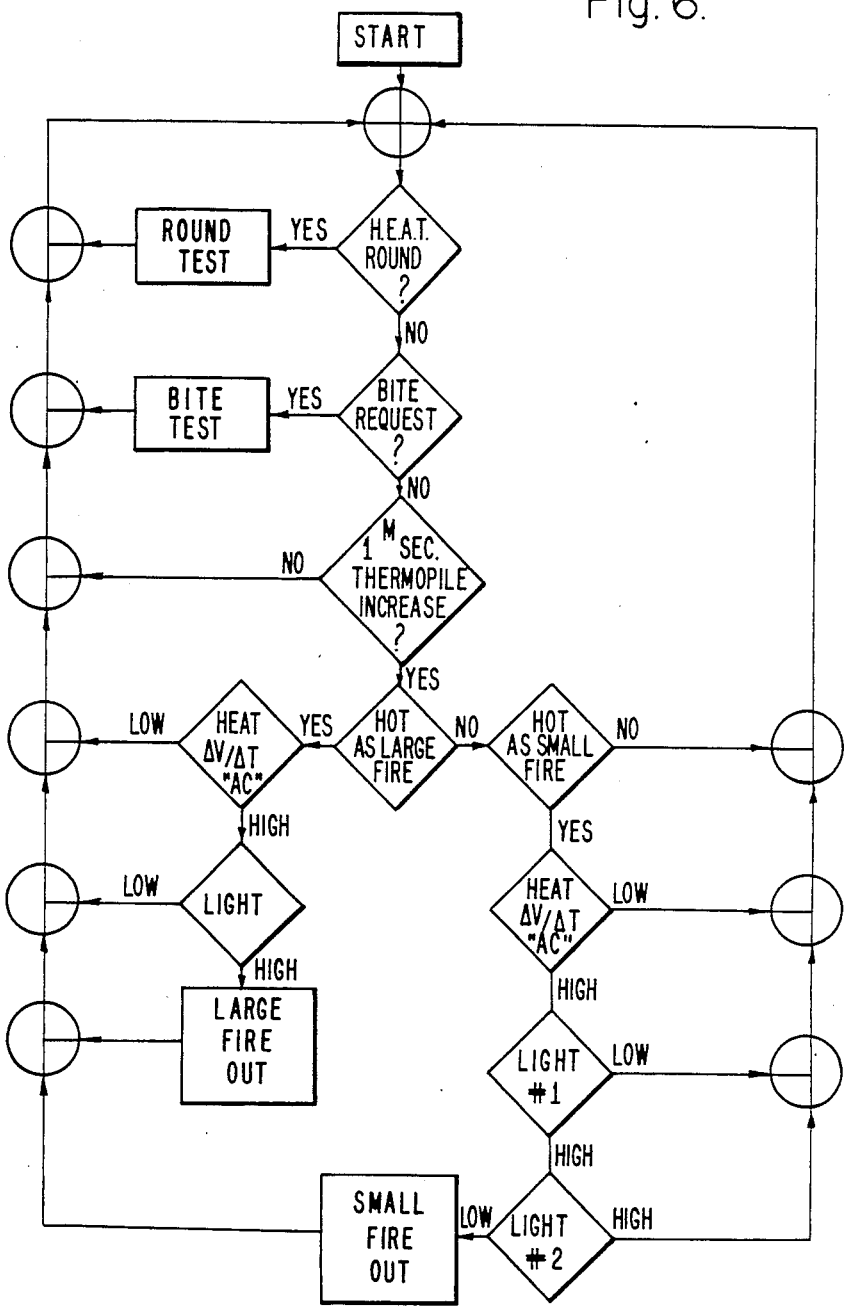
FIG. 6 is a flow diagram representing the operation of the microprocessor in the circuit of FIG. 5.

A simplified flow chart of the 1802 program for the microprocessor 135 is shown in FIG. 6. The processor first looks at the signal from the HEAT round detector 140; if the signal is above a predetermined threshold level it will go to the HEAT round test part of the program. If not, the program checks for a "BITE" request. If no BITE request is present, the thermal detector is checked to see if the thermal detector signal has increased over a one millisecond interval.

If the thermal detector signal has increased by a measurable amount, the processor determines whether the level is high enough to be a large fire. If a large fire is detected, an AC signal derived from the input channels is monitored to determine if the fire is expanding. If the AC component is large enough to represent a large fire expanding, the photon detector signal is checked also. If the photon detector signal also exceeds the large fire threshold, a large fire output signal is provided from the level translator 138 (FIG. 5) to automatically trigger release of fire suppressant.

If the signal from the thermal detector 122 does not indicate a large fire, it is monitored to see whether or not a small fire is present. If the thermal detector signal is of sufficient amplitude to indicate a small fire, the AC component is checked to confirm the condition, after which a test is performed to see if the photon detector signal is between predetermined lower level No. 1 and upper level No. 2. If the photon detector level is within this range, a Small Fire Output signal is sent to illuminate lights on the display panel 164.

The circuit of FIG. 5 is also provided with a BITE drive stage 150 coupled to drive light emitting diodes 152 which are individually associated with the respective detectors 112, 122 and 140 under the control of the CPU 135. A separate BITE line 154 permits an operator to initiate the BITE test without waiting for the microprocessor sequence.

FIG. 5 also shows a power supply 160 for the circuit of FIG. 5 which is arranged to be connected to the CPU 135 through a replaceable code plug 162. This is a prewired plug-in element which is used to specify to the microprocessor the particular type of vehicle armor which is installed.

It is understood that the above-described embodiments are merely illustrative of the many possible specific embodiments which can represent applications of the principles of this invention. Numerous and varied other arrangements can be devised in accordance with these principles by those skilled in this art without departing from the spirit and scope of the invention.

What is claimed is:

1. A microprocessor controlled fire sensor system comprising:

a first detector for generating electrical signals in response to incident radiation within a predetermined first spectral band;

a second detector for generating electrical signals from incident radiation within a predetermined second spectral band;

first and second amplifiers respectively connected to the first and second detector for amplifying said signals from the first and second detectors, respectively, to levels compatible with microprocessor inputs;

a microprocessor including a central processing unit with memory (CPU) coupled to receive signals corresponding to the outputs of said amplifiers and process said signals in accordance with a pre-established computer program;

a multiplexer and an A/D converter connected in series between the amplifiers and the CPU to sequentially apply to the CPU digital signals corresponding to analog signals derived from the first and second detectors; and means within the microprocessor for comparing the received signals with at least one preselected threshold stored in the memory, with said means generating an output signal for initiating release of fire suppressant when at least one of the received signals exceeds said one preselected threshold.

2. The system of claim 1 further including a display panel and means for activating the display panel to indicate detected small fire radiation in the absence of signal conditions serving to initiate the release of the fire suppressant.

3. The system of claim 2 wherein the first and second amplifiers are gain variable and wherein the microprocessor further includes means for selectively varying the amplifier gains to maintain the voltage levels of the output signals from the amplifiers within the dynamic range of the microprocessor.

4. The system of claim 3 wherein the gain of each amplifier is settable to gain factors of 1, 16 and 256 and wherein the microprocessor includes means for selecting a gain factor appropriate to amplify the output signal level of the amplifiers to within the dynamic rasnge of the microprocessor.

5.The system of claim 4 wherein the microprocessor includes means for comparing the received signals with each other and with predetermined threshold levels for each of the received signals and said means for generating a fire suppressant release signal only in the event that the received signals exceed their respective threshold levels and the difference between said received signals is in excess of a predetermined amount.

6. The system of claim 5 wherein the microprocessor further delay means for inhibiting the generation of the fire suppressant release signal until the difference between said received signals is in excess of said predetermined amount for a predetermined time interval.

7. The system of claim 1 further including means controllable by the microprocessor for testing the operating condition of the system at predetermined regular intervals.

8. The system of claim 7 further including means for inhibiting the generation of a fire suppressant release signal during testing of the system.

9. The system of claim 7 further including means for causing the microprocessor to perform a self-analysis of microprocessor condition.

10. The system of claim 1 wherein the microprocessor comprises an Intel 2920 Signal Processor.

11. The system of claim 3 further including means within the microprocessor for maintaining the levels of the received signals for a preselect interval during a change in the gain factor of the variable gain amplifiers.

12. The system of claim 1 further including a third detector for generating signals from incident radiation in said first spectral band of substantially higher energy level than that detected by the first detector.

13. The system of claim 12 wherein the third detector is coupled to generate signals corresponding to high energy anti-tank (HEAT) round radiation incident at the third detector.

14. The system of claim 13 wherein the microprocessor includes means for testing for the occurrence of a HEAT round upon the application of signals generated by the third detector.

15. The system of claim 14 wherein the microprocessor includes means for comparing signals derived from the second and third detectors to detect the occurrence of a fire of sufficient intensity to warrant the release of fire suppressant.

16. The system of claim 15 wherein the microprocessor includes means for comparing signals derived from the first detector with the result of comparing the signals derived from the second and third detectors in order to provide an output control signals to initiate the release of fire suppressant.

17. The system of claim 16 wherein the microprocessor further includes means for indicating the presence or absence of a small fire when said result of said comparison does not indicate a large fire sufficient to trigger the release of the fire suppressant.

18. The system of claim 1 wherein the wavelength of the first spectral band is from 0.7 microns to 2.0 microns and the wavelength of the second spectral band is from 5 microns to 30 microns.

19. The system of claim 1 wherein the microprocessor is an RCA 1802 Signal Processor.

20. The system of claim 1 wherein said means within the microprocessor generates said output signal for releasing the fire supressant when both of the received signals are in excess of predetermined threshold levels and wherein said comparison indicates the absence of a signal condition associated with a flash radiation due to projectile penetration into the object being monitored by the system.

* * * * *